US011253108B2

(12) United States Patent
Fenna

(10) Patent No.: US 11,253,108 B2
(45) Date of Patent: Feb. 22, 2022

(54) SHOWER

(71) Applicant: DLP Limited, Douglas (IM)

(72) Inventor: Iain Stuart Fenna, Peel (IM)

(73) Assignee: DLP LIMITED, Douglas (IM)

( * ) Notice: Subject to any disclaimer, the term of this patent is extended or adjusted under 35 U.S.C. 154(b) by 0 days.

(21) Appl. No.: 16/689,470

(22) Filed: Nov. 20, 2019

(65) Prior Publication Data

US 2020/0154952 A1 May 21, 2020

(30) Foreign Application Priority Data

Nov. 20, 2018 (GB) ..... 1818893

(51) Int. Cl.

| | |
|---|---|
| ***A47K 3/30*** | (2006.01) |
| *E04B 1/344* | (2006.01) |
| *A47K 3/32* | (2006.01) |

(52) U.S. Cl.

CPC ..... *A47K 3/30* (2013.01); *A47K 3/32* (2013.01); *E04B 1/344* (2013.01)

(58) Field of Classification Search

CPC . A47K 3/30; A47K 3/305; A47K 3/32; A47K 3/325; A47K 2003/305; E05D 1/04; E05Y 2900/114; E04B 1/344

See application file for complete search history.

(56) References Cited

U.S. PATENT DOCUMENTS 3,418,665 A * 12/1968 Long ..... A47K 3/30 4/610
3,952,463 A * 4/1976 Lane ..... E04H 15/34 52/63
5,070,550 A * 12/1991 Reeves ..... A47K 3/30 4/608
5,332,021 A 7/1994 Todd et al.
5,365,619 A * 11/1994 Solomon ..... A47K 3/30 4/609
5,662,069 A 9/1997 Smith
(Continued)

FOREIGN PATENT DOCUMENTS

CN 208346731 U 1/2019
DE 10207024 A1 8/2003
(Continued)

OTHER PUBLICATIONS

GB 1818893.8 Search Report dated Apr. 29, 2019.
EP 19177768.9 Extended Search Report dated Feb. 28, 2020.

*Primary Examiner* — J C Jacyna

(74) *Attorney, Agent, or Firm* — Nixon Peabody LLP; Jeffrey L. Costellia

(57) ABSTRACT

A shower-screen pivot device comprises a seating element mountable to a shower surface, and a screen-support element for supporting at least part of a shower screen. The seating element has a first panel-pivot element, and the screen-support element has a second panel-pivot element which is engagable with the first panel-pivot element. When interengaged, the first and second panel-pivot elements are rotatable relative to each other about a panel-pivot axis P which is parallel to a base of the seating element. This enables an installer to semi-erect a shower-screen panel with a lower edge watertightly sealed, and leave it unattended and self-supported whilst attending to other panels.

12 Claims, 6 Drawing Sheets

(56) References Cited

U.S. PATENT DOCUMENTS

| | | | | |
|---|---|---|---|---|
| 6,148,451 | A * | 11/2000 | DeBraal | A47K 3/34 4/557 |
| 2010/0024169 | A1* | 2/2010 | Self | A47K 3/36 16/354 |
| 2010/0058531 | A1* | 3/2010 | Bullis | A47K 3/30 4/584 |
| 2016/0206157 | A1* | 7/2016 | Ball | A47K 3/34 |
| 2017/0027388 | A1* | 2/2017 | Schultz | E05D 15/0626 |

FOREIGN PATENT DOCUMENTS

| | | | |
|---|---|---|---|
| EP | 0541877 | A1 | 5/1993 |
| FR | 2337806 | A1 | 8/1977 |
| FR | 2896144 | A1 | 7/2007 |
| GB | 2219336 | A | 12/1989 |

* cited by examiner

SHOWER

CROSS-REFERENCE TO RELATED APPLICATIONS

This application claims priority to and the benefit of British Patent Application No. GB 1818893.8, and titled "IMPROVEMENT IN OR RELATING TO A SHOWER," filed Nov. 20, 2018, which is incorporated herein by reference in its entirety.

FIELD

The present invention relates to a shower-screen pivot device, to a shower comprising such a device, and to a method of assisting, preferably single-person, installation of a shower screen.

BACKGROUND

Most dwellings have a shower at least, and many of these showers are standalone or separate areas within a bathroom rather than being part of an existing bath. The showering area may be formed either by a shower tray which is placed on or recessed into the floor of the bathroom, or by a wet floor which is formed by a tiled or plastics covered flooring having a predetermined fall to a runoff-water drainage outlet.

In relation to the former option when using a shower tray, but also applicable to the later 'wet floor' option, as part of the installation a shower screen will often be erected to contain the runoff shower water, particularly to prevent or limit splashing and spraying across the rest of the bathroom.

Installing a shower screen enclosure can be troublesome and time consuming. The panels of the screen must be watertightly sealed to the mounting surface to prevent or discourage leakage thereunder. Additionally, multiple panels typically have to be interconnected to provide upright watertight joints therebetween. With this in mind along with many shower-screen panels being taller than the average installer and thus particularly unwieldy, trying to provide all the required interconnections, particularly if there is only a single installer, along with the fastening together of the panels, all almost simultaneously, can be particularly problematic.

The present invention seeks to provide a solution to this problem.

SUMMARY

According to a first aspect of the invention, there is provided a shower-screen pivot device comprising a seating element mountable to a shower surface, and a screen-support element for supporting at least part of a shower screen, the seating element having a first panel-pivot element and the screen-support element having a second panel-pivot element which is engagable with the first panel-pivot element, so that, when interengaged, the first and second panel-pivot elements are rotatable relative to each other about a panel-pivot axis which is parallel to a base of the seating element.

The provision of such a pivot device allows a watertight seal to first be created at or adjacent to a bottom edge of an associated panel, even whilst the panel is rested at a non-vertical angle and whilst further panels are attended to. The installer thus only needs to focus on finally interconnecting the panels without having to be concerned about at least the lowermost seal to the shower tray or wet floor.

Preferably, at least one of the first or second panel-pivot elements includes a part-cylindrical surface, and the other of the first or second panel-pivot elements is laterally slidable on the part-cylindrical surface. In this case, the pivot device may further comprise, when the part-cylindrical surface is on the first panel-pivot element, a fastener-access opening partway therealong. Furthermore, the said other of the first or second panel-pivot elements may conveniently include a channel in which the part-cylindrical surface is receivable. The part-cylindrical surface or similar forms a saddle or seat which allows the opposing panel-pivot element, when seated thereon, to ride, glide or otherwise slide thereacross as it rotates thereover. Beneficially, with the part-cylindrical surface being spaced above a water-receiving surface of the shower tray or wet floor, along with being isolated from water ingress, the part-cylindrical surface can be discontinuous along its length to allow access to mechanical fastening means, such as a screw or bolt, for securing the pivot device to the water-receiving surface or a surround thereof.

A shower-screen pivot device may further comprise a watertight seal interposed between the first and second panel-pivot elements. Such an arrangement is particularly beneficial in that the lower part of the pivot device can be sealingly engaged with the mounting surface of the shower try or wet floor, and then, as the panel is erected, an additional watertight seal is further created between the two parts of the device. In this case, the watertight seal is preferably carried by the first panel-pivot element at or adjacent to an inwardly-facing side wall thereof. This conveniently enables the upper part to slide into watertight engagement with the lower part, as rotation completes and the two parts align in an in-use configuration.

Advantageously, the screen-support element further includes a depending front wall and a depending back wall having a shorter lateral extent than the front wall. In this case, the first panel-pivot element may include a recess for accommodating the back wall of the screen-support element. The different drops of the front and back walls or skirts accommodate the relative rotation of the two parts of the pivot device, whilst also allowing a flush or substantially flush inside edge or stop at or closely adjacent to the surface of the shower tray or wet floor. To accommodate a slightly longer drop of the back wall or skirt, along with a more positive engagement of the upper part with the lower part of the pivot device, a marginal return or slight undercut is formed in the lower part. Where the seating element or lower part includes the aforementioned part-cylindrical surface, the surface extends beyond an equatorial line of a lateral cross-section of the seating element in order to provide the recess that can at least in part receive a lowermost edge of the back wall or back skirt of the upper part.

Additionally, the back wall may be canted to be spaced from the said recess of the first panel-pivot element, when the first and second panel-pivot elements are centred relative to each other. The back wall or skirt is optionally profiled, having an outward splay or lateral curve along its longitudinal extent. This accommodates an outer, typically curved surface, of the lower part of the pivot device which, together with the above-described recess or undercut, permits a greater degree of rotation movement of the screen-support element or upper part relative to the seating element or bottom part.

When the first and second panel-pivot elements are centred relative to each other, the front wall is preferably at or adjacent to a plane of the base of the seating element. As such, a user cannot easily observe the seating element, which may be deemed unsightly, enables a further barrier to water egress from the shower tray or wet floor, enables a neat and uniform finished appearance, and permits a watertight seal to be achieved at a rear of the front wall or front skirt.

A shower-screen pivot device which is preferably in the form of a kit of parts. Although the pivot device may be provided in part-assembled, for example, with the screen-support element being pre-installed by the manufacturer on a lower edge of the shower-screen panel, the device may also come entirely separately and disassembled. This thus enables easy storage and transport, whereby the device may be entirely assembled purely on-site.

In accordance with a second aspect of the invention, there is provided a shower which comprises a shower tray, a seating element mounted to a shower surface of the shower tray, at least one shower-screen panel, and a screen-support element extending along a lower edge of the shower-screen panel, the seating element having a first pivot element and the screen-support element having a second pivot element, the first and second pivot elements engaged to form a pivot axis which is parallel to a base of the seating element, whereby the said at least one shower-screen panel, whilst mounted to the shower tray, can tilt from the vertical. The vertical tilt enables positive engagement to be maintained, along with a lowermost watertight seal to the mounting surface of the shower tray or wet floor, whilst allowing the panel to be temporarily supported or rested against a neighbouring surface, such as a bathroom wall or other upright member. The other panel or panels can thus be attended to without having to balance the first panel, and the first panel can be pivoted back to the vertical once the neighbouring panel is ready for engagement.

In accordance with a third aspect of the invention, there is provided a method of assisting installation of a shower screen, preferably using a shower-screen pivot device in accordance with the first aspect of the invention, the method comprising the steps of: (a) providing a shower-screen pivot device having a panel-pivot axis which is parallel to a shower surface, the shower-screen pivot device being interposed between a first panel of the shower screen and the shower surface; (b) tilting the first panel away from vertical whilst maintaining engagement via the shower-screen pivot device, so as to rest the tilted first panel against an upright element at or adjacent to the shower surface; (c) mounting a second panel of the shower screen to the shower surface; and (d) pivoting the tilted first panel back towards vertical via the shower-screen pivot device to enable engagement with the second panel. In this case, in step (c), the second panel of the shower screen may be mounted to the shower surface via the or another said shower-screen pivot device, the second panel being tiltable away from the vertical whilst maintaining engagement via said the or another shower-screen pivot device, so as to be restable against the or another upright element at or adjacent to the shower surface.

BRIEF DESCRIPTION OF THE DRAWINGS

The present invention will now be more particularly described, by way of example only, with reference to the accompanying drawings, wherein.

DETAILED DESCRIPTION

Figure 1:
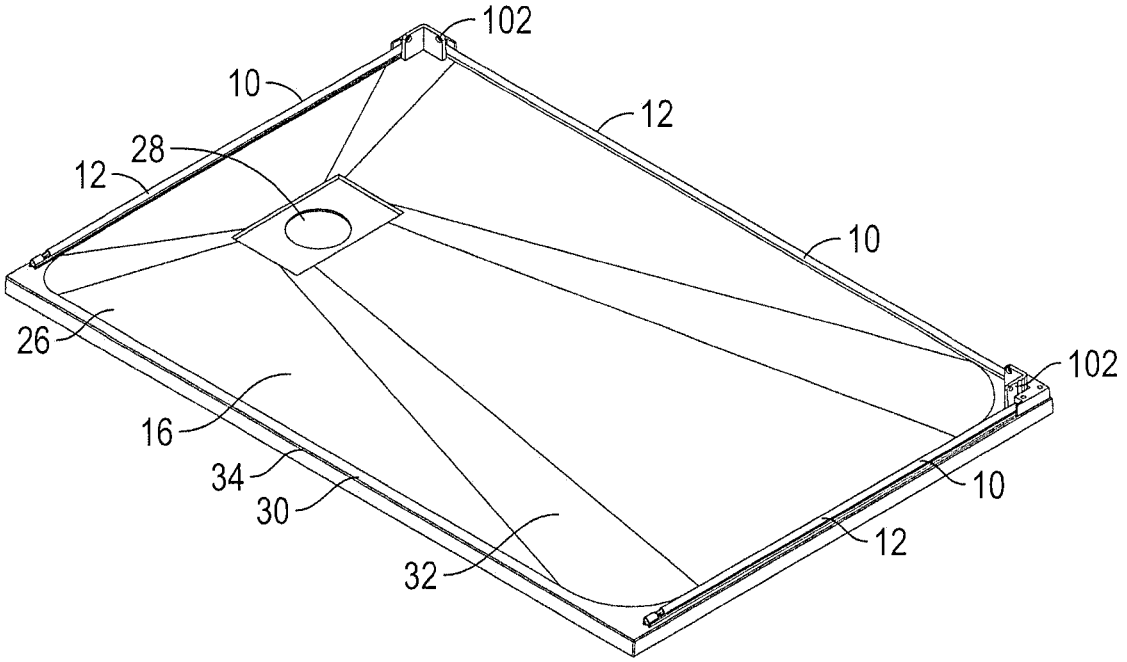
FIG. 1 shows a shower tray having a seating element of a shower-screen pivot device, in accordance with the present invention.
Figure 2:
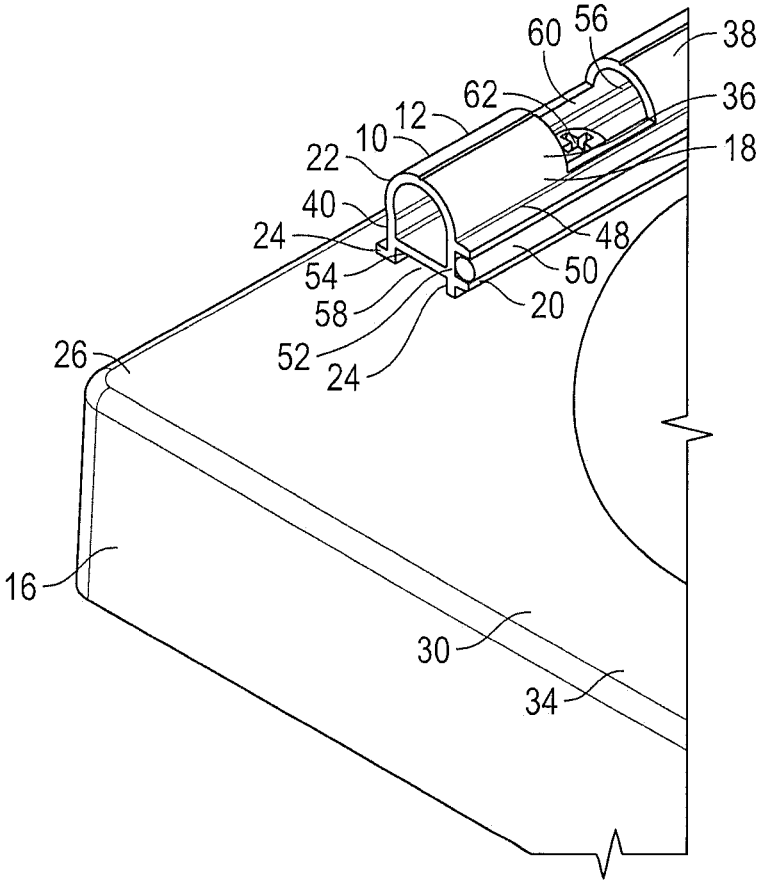
FIG. 2 is an enlarged portion of an end of the seating element, shown in FIG. 1.
Figure 3:
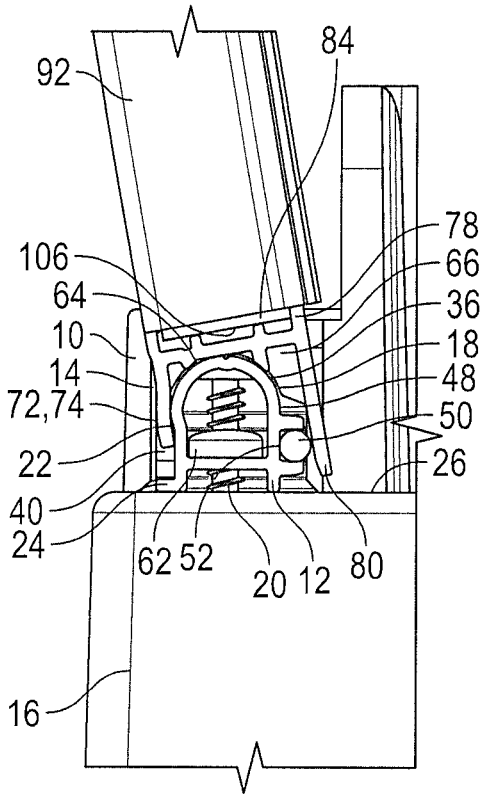
FIG. 3 is an end-on side view of the pivot device, showing the aforementioned seating element and an opposing screen-support element thereon, the screen-support element being rotated off-centre relative to the seating element.

Referring firstly to FIGS. 1 to 4 of the drawings, there is shown a shower-screen pivot device 10 which comprises a seating element 12, and a screen-support element 14 which, in this embodiment, is separate or separable from the seating element 12. However, the two parts may be pivotably fastened to each other, for example, by utilising inter-hinged end caps.

Both the seating element 12 and the screen-support element 14 may beneficially be rigid or substantially rigid elongate members, and conveniently may be extruded from metal, plastics or another suitable material, or a composite thereof.

A benefit of having the seating element 12 and the screen-support element 14 extruded is to allow a length to be cut or sectioned on-site according to an installation requirement. Bespoke tailoring using a cutting tool by an installer to match or correspond to a side dimension of a shower tray 16 or wet floor within a showering area, such as a bathroom, is thus accommodated.

The seating element 12 includes a support body 18 having a mounting base 20 at an in-use lower side thereof and a first panel-pivot element 22 at an in-use upper side thereof. The mounting base 20 in this case is arranged to provide two flat linear edges 24 to mount to a waste-water runoff surface 26 of the showering area. Such a waste-water runoff surface 26 is typically horizontal or substantially horizontal, and may provide a slight inwardly directed pitch to create a predetermined fall towards a waste-water drain 28 formed or located within the waste-water runoff surface 26.

In the case of a shower tray 16, the waste-water runoff surface 26 may include a generally raised perimeter edge 30 that surrounds a main user-support portion 32 on which a user usually stands during use of an associated shower head. The mounting base 20 is adapted to flushly seat on an upper surface 34 of such a raised perimeter edge 30 with little to no gap between the upper surface 34 and the two flat linear edges 24, thereby minimising or eliminating water ingress therebeneath.

In the case of a wet floor, the waste-water runoff surface may simply be a waterproof plastics covering or tiled covering, for example, having a predetermined flat and/or fall to a discharge drain and on which a user stands during washing.

Although the two edges 24 of the mounting base 20 are preferably planar and linear, they may be curved or include more than one linear length to accommodate different shapes and design of shower tray or wet floor, or a particular, potentially irregular, configuration of the bathroom.

The first panel-pivot element 22 includes a part-cylindrical surface 36 which extends in parallel with the mounting base 20 along all or substantially all of a longitudinal extent of the support body 18. The part-cylindrical surface 36 forms an upper convex dome defining a curved articulating surface 38 across at least part, and in this case a majority, of a lateral extent of the seating element 12.

Figure 4:
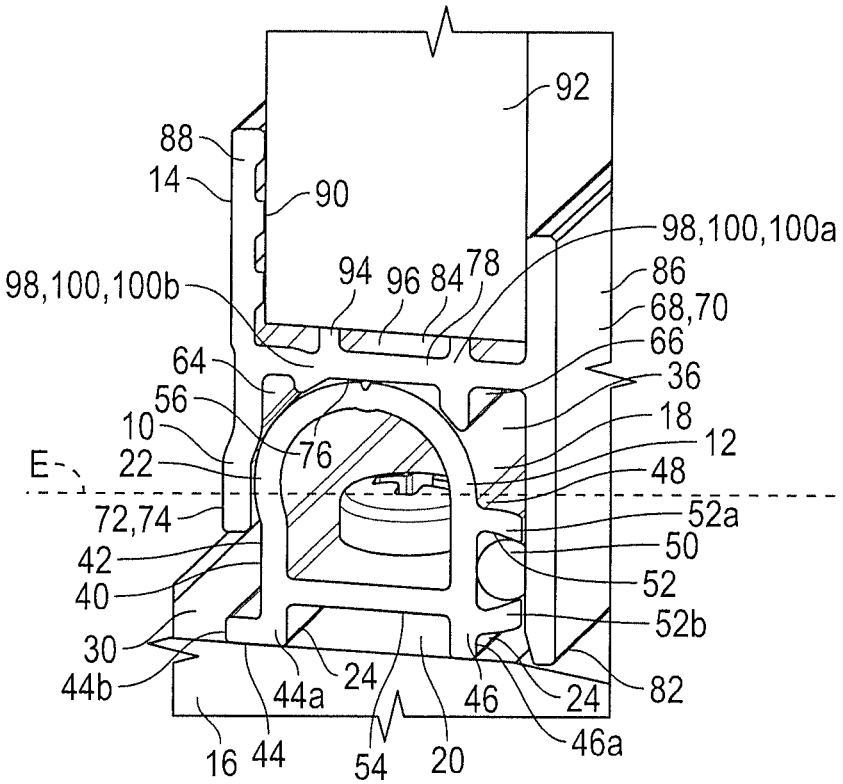
FIG. 4 is an orthogonal view, similar to FIG. 3, showing the seating element and the screen-support element of the pivot device when brought into a centralised or symmetrical alignment.
Figure 5:
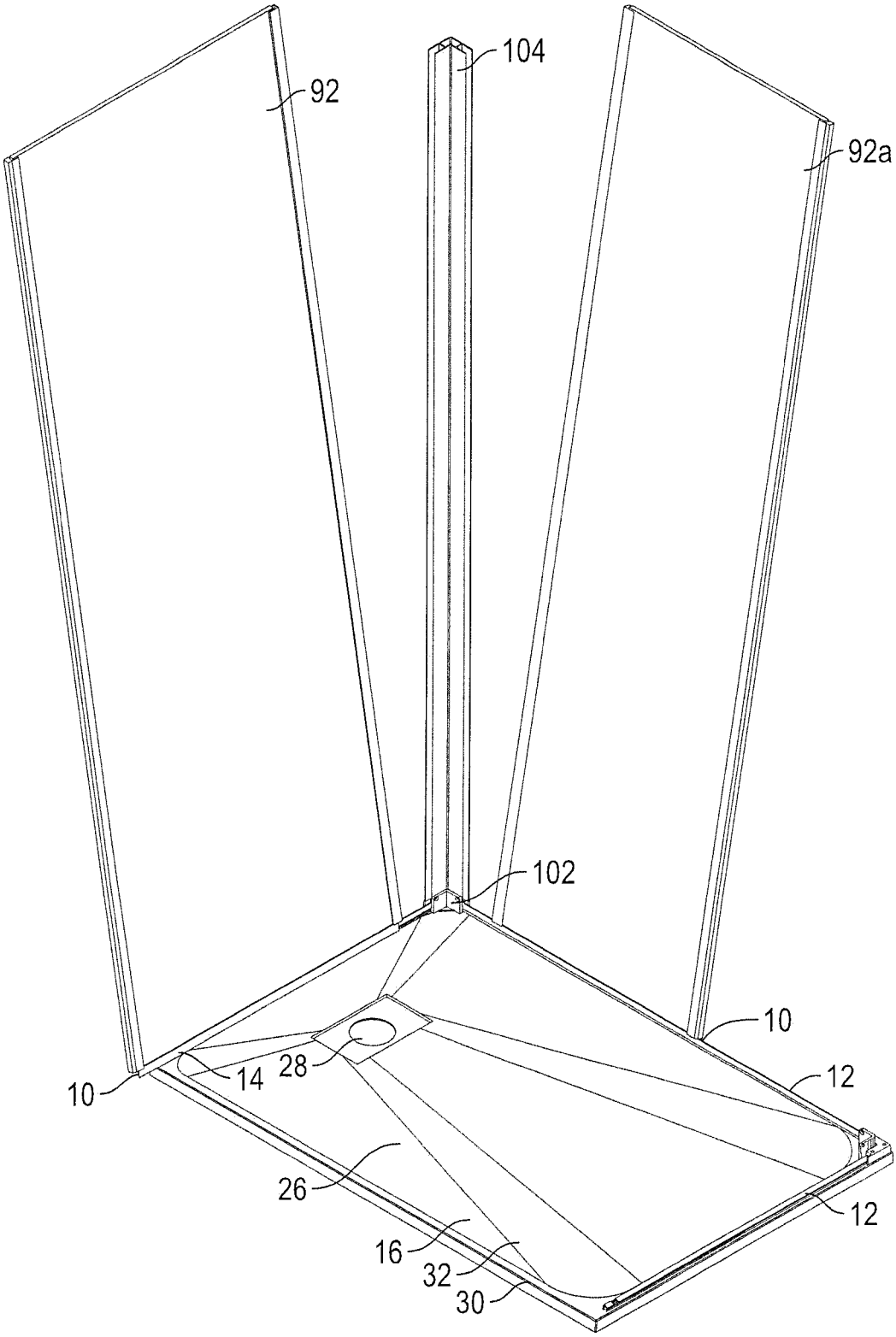
FIG. 5 shows the shower tray of FIG. 1 utilising the pivot device to mount two shower-screen panels.

The part-cylindrical surface 36 meets an outer side wall 40 of the support body 18 at a position which is preferably beyond an equatorial line E. As will be understood hereinafter, by providing the outer side wall 40 slightly inboard of a radial extent of the part-cylindrical surface 36 improves a range of articulation during pivoting of the two parts 12, 14 of the pivot device 10. To this end, the outer side wall 40 is slightly recessed or can be said to provide an undercut 42 along one side of the seating element 12, as best seen in FIG. 4.

To better accommodate rotational torque imparted laterally to the seating element 12 during pivoting, the outer edge 44 of the said two edges 24 of the mounting base 20 may be formed as a leg 44*a* with an out-turned foot 44*b*. This enables improved bracing, along with better weight and pressure distribution.

The inner edge 46 of the two edges 24 of the mounting base 20 may have a similar leg and foot design. However, it has been found that a single depending leg 46*a* without an out-turned foot is sufficient, due to only outward pivoting being typically required in most circumstances. However, it will be understood that, by mirroring the design on the inside, two-way pivoting can be accommodated, or by reversing the shower-screen pivot device 10, inward-only pivoting can be provided as opposed to outward-only pivoting.

An inner side wall 48 of the support body 18 preferably includes a user-facing sealing element 50. In this embodiment, the sealing element 50 may beneficially be an elongate elastomeric or rubber strip having, for example, a circular lateral cross-section along at least a majority of its longitudinal extent.

The inner side wall 48 is advantageously provided with a projecting seating channel 52 having marginally in-turned outer edges 52*a*, 52*b* and/or walls. A width of an opening to the projecting seating channel 52 between the in-turned outer edges 52*a*, 52*b* and/or walls is just smaller than a diameter of the sealing element 50. A depth of the projecting seating channel 52 is just larger than a radius of the sealing element 50. With such a preferred configuration, the sealing element 50 can be press-fit into and positively engaged by the projecting seating channel 52.

Extending between the outer side wall 40 and the inner side wall 48 is a bottom wall 54, forming part of the mounting base 20 of the support body 18. The bottom wall 54 is preferably raised relative to the outer edge 44 and the inner edge 46. The support body 18 is thus preferably hollow, defining a tube with an open interior cavity 56 therealong, in addition to a void or space 58 between the outer edge 44, inner edge 46 and bottom wall 54 to accommodate a settable sealant which prevents or limits the passing of runoff waste shower water.

Conveniently, the part-cylindrical surface 36 of the first panel-pivot element 22 may include one or more fastener-access openings 60 spaced-apart therealong. Such fastener-access openings 60 may be performed through the part-cylindrical surface 36, which is therefore a discontinuous articulating surface, and/or may be formable by an installer as necessity dictates. In this latter case, the material of the seating element 12 may be cut by a suitable tool, such as a drill, knife or saw. To aid the cutting process, one or more guide lines may be included, and/or such markings or indications may be formed by a removal of a portion of the material of the seating element 12 thus providing weakened portions enabling easier cutting and/or a marginal trough to prevent or limit undesirable wandering of the cutting device.

The fastener-access opening 60 permits access to the bottom wall 54 of the support body 18, thus allowing a screw-threaded fastener 62 to be inserted therethrough. This permits the option of providing the seating element 12 with a positive mechanical connection to the shower tray 16, wet floor or other washing surface, in addition to the use of sealant.

The screen-support element 14 includes a second panel-pivot element 64 having a pivot channel 66 in which the part-cylindrical surface 36 is receivable. The pivot channel 66, which faces downwardly when in use, is dimensioned to seat and pivot, rotate or slide laterally on the part-cylindrical surface 36.

To constrain the pivot channel 66 when engaged with the seating element 12, the screen-support element 14 further includes a depending front wall 68 forming a first side wall 70 of the pivot channel 66, and a depending back wall 72 forming a second side wall 74 of the pivot channel 66. An upper surface 76 of the second panel-pivot element 64 extends from the first side wall 70 to the second side wall 74, thereby forming a cross-channel wall 78 of the pivot channel 66 and closing one longitudinal side of the pivot channel 66 whilst leaving the opposing longitudinal side open to receive the screen-support element 14.

The depending front wall 68, forming the first side wall 70 of the pivot channel 66, preferably has a longer lateral extent than the depending back wall 72 that forms the second side wall 74. The greater width of the first side wall 70 enables automatic engagement of an inner surface 80 thereof with the sealing element 50 as the two parts 12, 14, being the seating element 12 and the screen-support element 14, of the pivot device 10 rotate relative to each other to adopt a dead centre, non-rotated, or aligned condition.

Figure 9:
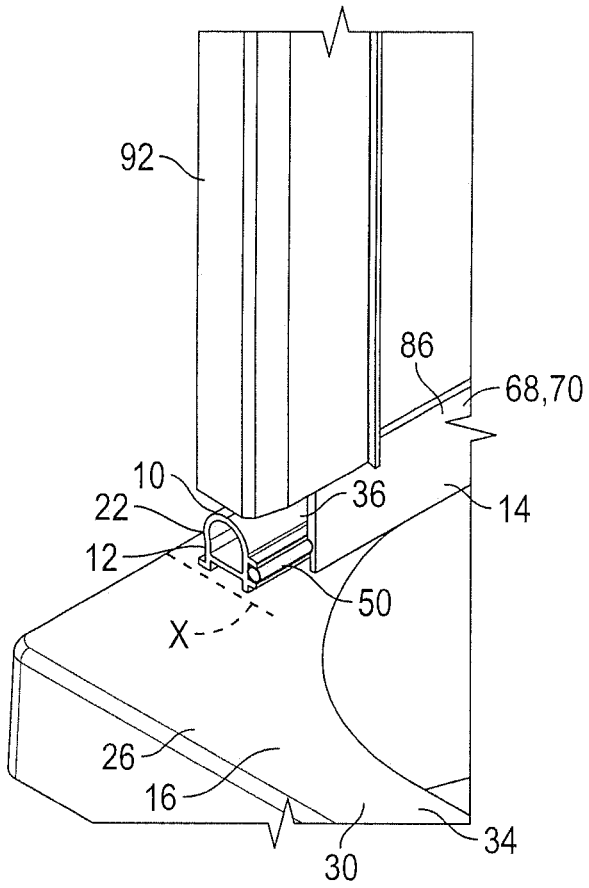
FIG. 9 is a further enlarged view of the portion of the shower tray and the shower-screen panel, showing the automatic formation of a watertight seal within the pivot device as the panel is brought to the vertical.

Preferably, a drop or lateral extent of the depending front wall 68 terminates at or adjacent to a plane X, shown in FIG. 9, of the mounting base 20 of the seating element 12, such that an in-use lowermost longitudinal edge 82 of the depending front wall 68 forms a vertical stop due to engagement or impingement with a mounting surface of the shower tray 16 or wet floor. This prevents or limits the screen-support element 14 from over-rotating towards the user support area of the shower installation, and consequently beyond or much beyond the vertical.

Furthermore, with the above-described configuration, the depending front wall 68 which in-use faces the user of the shower, presents a flush or substantially flush finish between the pivot device 10 and the shower tray 16 or wet-floor. Consequently, the flush finish also has the benefit of inhibiting runoff waste water flow into and beneath the pivot device 10.

The depending back wall 72 is preferably canted, so to allow a gap to the recessed outer side wall 40 of the seating element 12. A lateral profile of the depending back wall 72 is, at least in part, partially arcuate or curved to accommodate the part-cylindrical surface 36 of the seating element 12. During relative pivoting of the two parts 12, 14, the depending back wall 72 can thus slide slightly inwards to meet and abut the recessed outer side wall 40, thereby enabling an increased angle of rotation between the two parts 12, 14.

A panel channel 84 is formed along an upper portion of the screen-support element 14. The panel channel 84 opposes the pivot channel 66, being in back-to-back relationship and thus contiguous with a common shared wall, in this case being the aforementioned cross-channel wall 78.

The panel channel 84 includes an upright front wall 86 which extends from the cross-channel wall 78 and contiguously with the depending front wall 68, and an upright back wall 88 which extends also from the cross-channel wall 78 and contiguously with the depending back wall 72.

In this embodiment, it is preferred that the upright back wall 88 upstands with a greater lateral extent than the upright front wall 86, to better brace a panel when pivoted.

Furthermore, to provide improved engagement and/or to accommodate sealant or a curable fastening compound, for example, an inner surface of one or both of the upright front wall 86 and the upright back wall 88 may include one or more longitudinal channels and/or ridges, protrusions or other gripping means 90.

A lateral extent of the panel channel 84 is sufficient to receive a shower-screen panel 92 as a slidable fit. Such a fit may be a tolerance or interference push-fit, and/or may include suitable gaps, spaces or voids for a sealant or other bonding agent to be utilised therein. To this end, it may be beneficial to include one or more ribs, channels or other spacing means 94 in or on an in-use upper surface 96 of the cross-channel wall 78 to enable improved sealing and/or retainment. Refer to FIG. 4.

An in-use lower surface of the cross-channel wall 78, corresponding to the upper surface 76 of the second panel-pivot element 64, preferably utilises one or more rotation guides 98. In this case, two laterally spaced-apart rotation guides 98 are provided, preferably being depending legs or ribs 100. Each leg or rib 100, in this embodiment, may conveniently be continuous and linear, extending at least a majority of a longitudinal extent of the screen-support element 14.

A first one of the ribs 100*a*, being closer to the depending front wall 68, may project or depend to a greater depth or width than a second one of the ribs 100*b*. The first rib 100*a* may also be spaced further from the depending front wall 68 than the second rib 100*b* from the depending back wall 72. This is due to the incorporation of the sealing element 50.

The deeper first rib 100*a* forms a more stable longitudinal pivot mounting with the depending back wall 72 as the two interengaged parts, being the seating element 12 and the screen-support element 14, slide laterally relative to each other. A pivot axis P which is parallel to the mounting base 20 of the seating element 12 is thus defined by the pivot device 10, once the screen-support element 14 is seated on the seating element 12.

To accommodate the lateral slidable rotation, one or both of the first and second ribs 100*a*, 100*b* may be chamfered or angled to better accommodate the part-cylindrical surface 36 of the first-panel pivot element.

In use and with particular reference to FIGS. 5 to 9, the shower-screen pivot device 10 is typically transported to the installation site as a kit or in separated part form. Once on site, and with the shower tray 16 or wet floor in place, the seating element 12 of the pivot device 10 is first mounted to a horizontal or substantially horizontal user-support shower surface of the shower tray 16 or wet floor. As explained above, for a shower tray 16, the seating element 12 is typically bonded using a waterproof or water-resistant sealant located between the two legs 44, 46 of the mounting base 20 to a perimeter edge 30, ledge, flange, rim portion or raised surface thereof, along with being engaged with a corner mounting block 102.

An upright panel support 104 is mounted to the corner mounting block 102, and a lowermost edge 106 of the shower-screen panel 92 is inserted into the panel channel 84 of the screen-support element 14. As described above, the panel channel 84 may include an adhesive or sealant to fasten and/or seal the shower-screen panel 92 within the panel channel 84.

The shower-screen panel 92, once engaged with the screen-support element 14, can be seated on the seating element 12. In this way, the first and second panel-pivot elements 22, 64 are interengaged via the location of the part-cylindrical surface 36 being accommodated within the lower channel to contact the depending first and second ribs 100*a*, 100*b*.

The installer can thus safely pivot the mounted shower-screen panel 92, whilst it is spaced from the upright panel support 104, about the longitudinal pivot axis P and as a result away from the vertical. Once the canted depending back wall 72 of the screen-support element 14 pivots into engagement with the recessed back wall of the seating element 12, rotation is halted and the shower-screen pivot device 10 retains the shower-screen panel 92 at this pivoted off-vertical angle.

The installer can then attend, in a similar manner, to any other shower-screen panel 92*a* around the perimeter of the shower tray 16 or wet floor.

Figure 6:
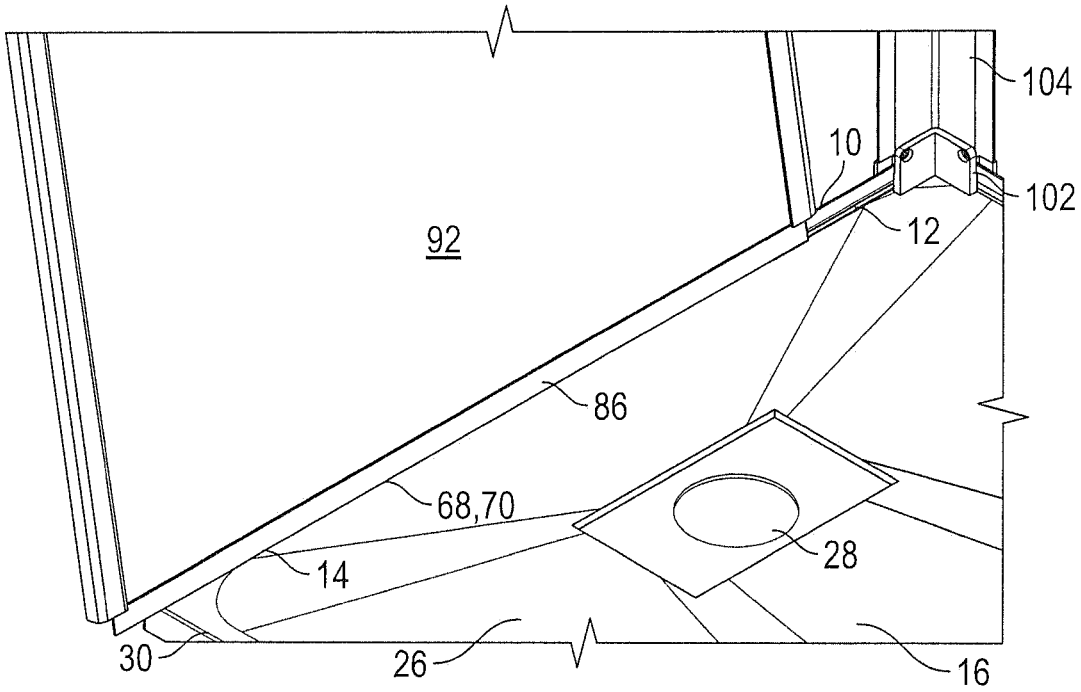
FIG. 6 is an enlarged portion of the shower tray, pivot device, and one shower-screen panel of FIG. 5.
Figure 7:
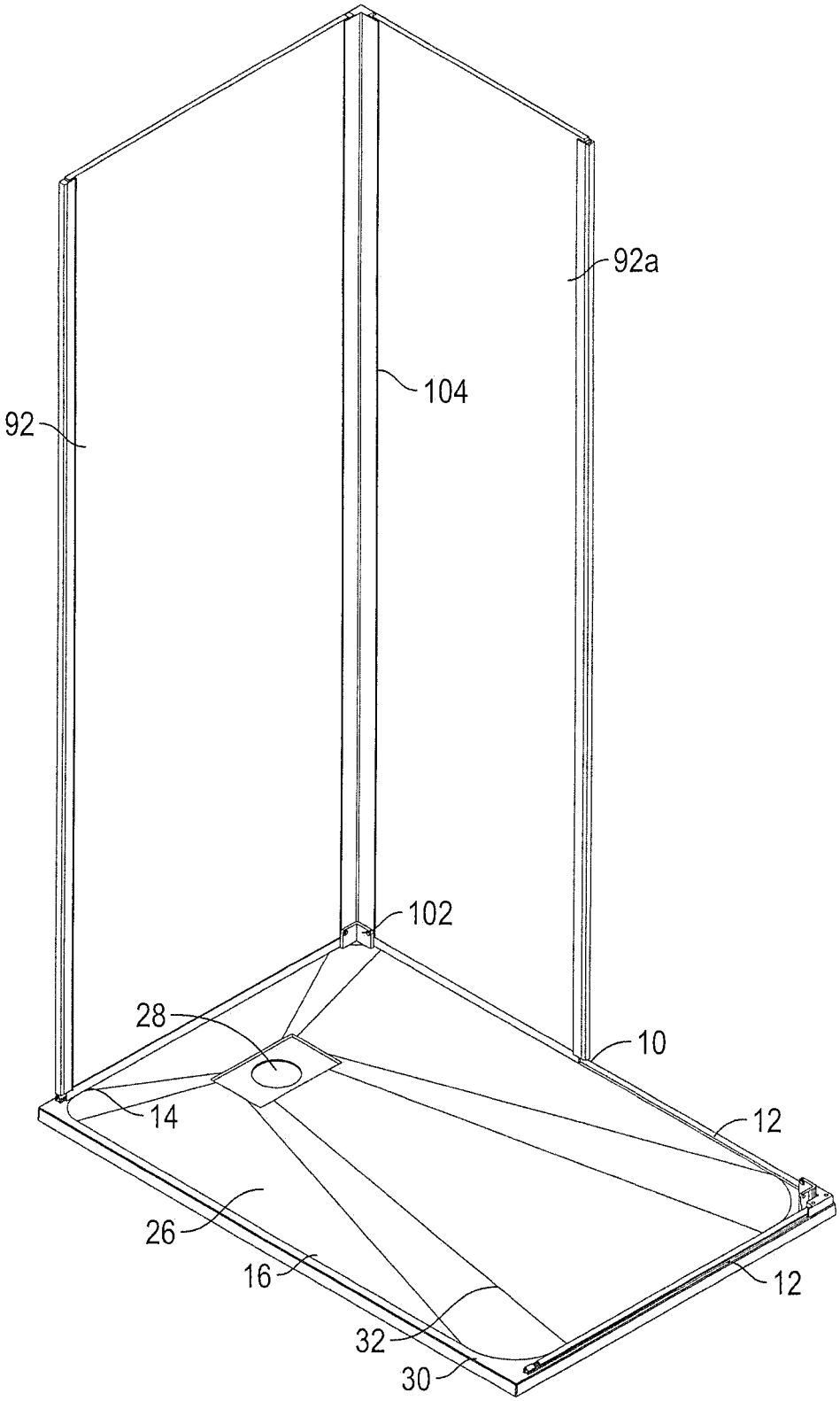
FIG. 7 is similar to FIG. 5, but showing the panels pivoted to their upright or vertical installed conditions.
Figure 8:
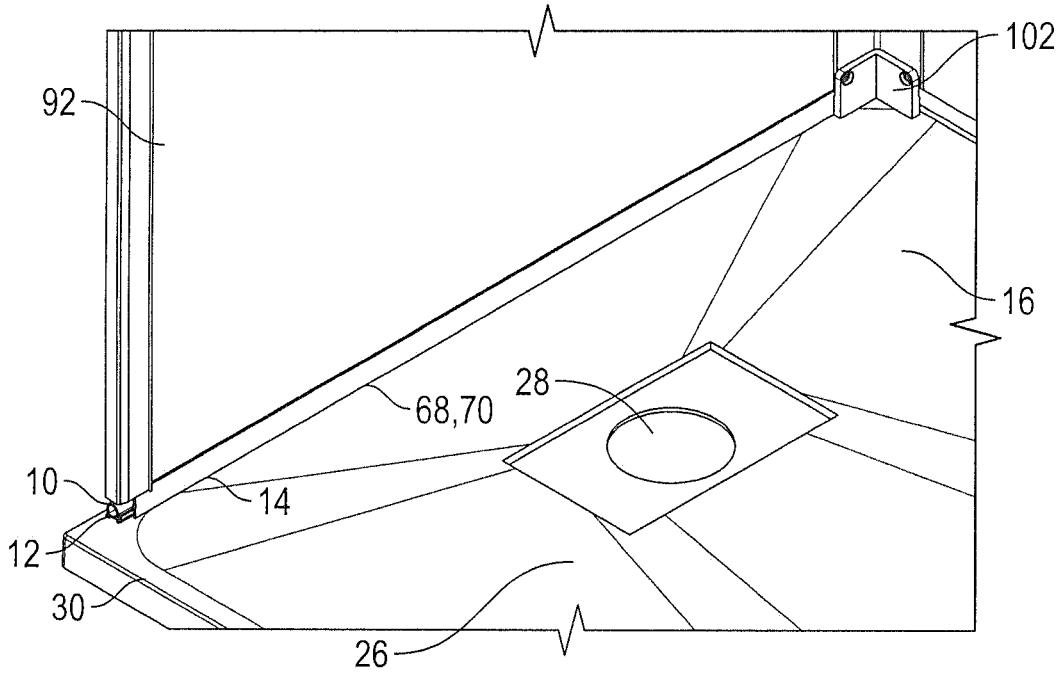
FIG. 8 is a first enlarged view of a portion of the shower tray and one of the shower-screen panels, as shown in FIG. 7.

Once the pivoted shower-screen panels 92, 92*a* are in place, the installer can return each shower-screen panel 92, 92*a* in turn to its upright or vertical condition, and, if required, slide it longitudinally to an install position, as seen when comparing FIGS. 6 and 8. Connection and watertight sealing in the normal way to an associated upright panel support 104, neighbouring shower-screen panel 92, 92*a*, and/or panel connector interposed between adjacent shower-screen panels can thus take place.

Although it is preferred that the first panel-pivot element 22 includes a part-cylindrical surface 36 to accommodate articulation of the second panel-pivot element 64, the first and second ribs may be provided on the first panel-pivot element and the part-cylindrical surface may be provided on the second panel-pivot element.

Furthermore, although the part-cylindrical surface 36 defines a convex or domed sliding surface, it may define a concave or dished sliding surface on either of the parts.

It may also be feasible to utilise a multi-faceted or polygonal cross-sectional profile for the articulating surface, and/or a toothed surface to enable indexing. In this way, a staged, notched or indexed installer-controlled rotation of the screen-support element relative to the seating element can be achieved, instead of a simpler freely slidable pivoting between the two parts 12, 14.

Although the sealing element 50 may beneficially be carried by the seating element 12, it or a further sealing element may be carried by the depending front wall.

One or more fastener-access openings 60 are described above. However, an adhesive may solely be used to connect the seating element to the shower surface. As such, the fastener-access openings 60, in certain embodiments, may be omitted.

Although it is preferred that the screen-support element 14 is separate and independent of the shower-screen panel 92, it is potentially feasible that the screen-support element could be formed integrally as one-piece with the shower-screen panel at or along a lowermost edge thereof. In this case, the panel channel of the screen-support element may not be required, and the pivot channel may be formed from the material of the shower-screen panel itself, for example, in the lowermost edge of the panel.

It is therefore possible to provide a shower-screen pivot device which assists, particularly but not necessarily exclusively, single user installation of a shower screen, particularly one having multiple sections or parts. It is also possible to provide a shower-screen pivot device which automatically seals against runoff shower-water ingress into the pivot device, as the two parts of the pivot device are brought into centred, vertical and/or non-pivoted alignment. Furthermore, watertight sealing of the shower panels at or adjacent to their lowermost edges can take place by the installer, before fully erecting and interconnecting the panels.

The words 'comprises/comprising' and the words 'having/including' when used herein with reference to the present invention are used to specify the presence of stated features, integers, steps or components, but do not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of examples only, and various other modifications will be apparent to persons skilled in the field without departing from the scope of the invention as defined herein.

The invention claimed is:

1. A shower-screen pivot device comprising:

a seating element to mount to a shower surface, the seating element having a first panel-pivot element; and a screen-support element to support at least part of a shower screen, the screen-support element having a second panel-pivot element to engage with the first panel-pivot element, so that, when interengaged, the first and second panel-pivot elements are rotatable relative to each other about a panel-pivot axis which is parallel to a base of the seating element;

wherein the screen-support element has a depending front wall having an inner surface which engages with a sealing element interposed between the first and second panel-pivot elements.

2. The shower-screen pivot device as claimed in claim 1, wherein at least one of the first or second panel-pivot elements includes a part-cylindrical surface, and the other of the first or second panel-pivot elements is laterally slidable on the part-cylindrical surface.

3. The shower-screen pivot device as claimed in claim 2, further comprising, when the part-cylindrical surface is on the first panel-pivot element, a fastener-access opening partway along the part-cylindrical surface.

4. The shower-screen pivot device as claimed in claim 2, wherein the said other of the first or second panel-pivot elements includes a channel in which the part-cylindrical surface is received.

5. The shower-screen pivot device as claimed in claim 1, wherein the sealing element is carried by the first panel-pivot element at or adjacent to an inwardly-facing side wall thereof.

6. The shower-screen pivot device as claimed in claim 1, wherein the screen-support element further includes a depending back wall having a shorterlateral extent than the front wall.

7. The shower-screen pivot device as claimed in claim 6, wherein the first panel-pivotelement includes a recess to accommodate the back wall of the screen-support element.

8. The shower-screen pivot device as claimed in claim 7, wherein the back wall is canted to be spaced from the said recess of the first panel-pivot element, when the first and second panel-pivot elements are centred relative to each other.

9. The shower-screen pivot device as claimed in claim 6, wherein, when the first and second panel-pivot elements are centred relative to each other, the front wall is at or adjacent to a plane of the base of the seating element.

10. A shower comprising:

a shower tray;

at least one shower-screen panel;

a seating element mounted to a shower surface of the shower tray, the seating element having a first pivot element; and a screen-support element extending along a lower edge of the shower-screen panel, the screen-support element having a second pivot element, the first and second pivot elements engaged to form a pivot axis which is parallel to a base of the seating element, whereby the at least one shower-screen panel, whilst mounted to the shower tray, can tilt from the vertical when mounted to the screen-support element, the screen-support element further having a depending front wall having an inner surface which engages with a sealing element interposed between the first and second pivot elements.

11. A method of assisting installation of a shower screen using the shower-screen pivot device as claimed in claim 1, the method comprising the steps of:

(i) providing the shower-screen pivot device having the panel-pivot axis which is parallel to the shower surface, the shower-screen pivot device being interposed between a first panel of the shower screen and the shower surface;

(ii) tilting the first panel away from vertical whilst maintaining engagement via the shower-screen pivot device, so as to rest the tilted first panel against an upright element at or adjacent to the shower surface;

(iii) mounting a second panel of the shower screen to the shower surface; and (iv) pivoting the tilted first panel back towards vertical via the shower-screen pivot device to enable engagement with the second panel.

12. The method as claimed in claim 11, wherein, in step (iii), the second panel of the shower screen is mounted to the shower surface via the shower-screen pivot device or an additional shower-screen pivot device, the second panel being tiltable away from the vertical whilst maintaining engagement via the shower-screen pivot device or the additional shower-screen pivot device, so as to be restable against the upright element or an additional upright element at or adjacent to the shower surface.

* * * * *